US007873520B2

(12) United States Patent
Paik

(10) Patent No.: US 7,873,520 B2
(45) Date of Patent: Jan. 18, 2011

(54) METHOD AND APPARATUS FOR TAGTOE REMINDERS

(76) Inventor: Oon-Gil Paik, 2828 Yew Street, #201, Vancouver (CA) V6K 4W5

( * ) Notice: Subject to any disclaimer, the term of this patent is extended or adjusted under 35 U.S.C. 154(b) by 605 days.

(21) Appl. No.: 11/856,726

(22) Filed: Sep. 18, 2007

(65) Prior Publication Data

US 2009/0076820 A1 Mar. 19, 2009

(51) Int. Cl.
*G10L 13/00* (2006.01)

(52) U.S. Cl. ..... 704/258; 704/260; 379/88.12

(58) Field of Classification Search ..... 704/258, 704/260; 379/88.12
See application file for complete search history.

(56) References Cited

U.S. PATENT DOCUMENTS 6,182,041 B1 * 1/2001 Li et al. ..... 704/260
6,760,412 B1 * 7/2004 Loucks ..... 379/88.13
7,327,834 B1 * 2/2008 Hiers et al. ..... 379/88.18
2003/0222765 A1 * 12/2003 Curbow et al. ..... 340/309.7
2005/0096095 A1 * 5/2005 Benco et al. ..... 455/567
2006/0129442 A1 * 6/2006 Wu ..... 705/8
2008/0103867 A1 * 5/2008 Moore et al. ..... 705/9
2008/0195455 A1 * 8/2008 May et al. ..... 705/9
2009/0149166 A1 * 6/2009 Habib et al. ..... 455/414.3

* cited by examiner

*Primary Examiner*—Daniel D Abebe
(74) *Attorney, Agent, or Firm*—Invent Capture, LLC; Samuel S. Cho

(57) ABSTRACT

A network-based text-to-speech (TTS) TagToe alert system is configured to take a user's textual and/or multimedia input to a TagToe user interface to schedule delivery of text-to-speech-converted TagToe information to one or more telephone call recipients. The text-to-speech converted TagToe information optionally includes e-commerce specific, location-specific, and/or product-specific information which may be presented to the one or more call recipients as additional voice information or interactive voice response (IVR) information. The TagToe alert system can be configured to provide an advanced level of integration between IP telephony and electronic transactions and online services for optimized efficiency and improved revenue to e-commerce.

20 Claims, 13 Drawing Sheets

TagToe This item for Purchage Reminder

METHOD AND APPARATUS FOR TAGTOE REMINDERS

BACKGROUND

This invention generally relates to a voice reminder system. More specifically, the invention relates to a computer network-based text-to-speech voice reminder system operatively connected to a telephone or cellular network for transmission of text-to-speech voice messages and other information to a telephone call recipient.

Internet Protocol telephony, or IP telephony, has become a popular application of computer network usage in recent years. Empowered and enabled by voice-over-IP technology (i.e. VoIP), IP telephony transmits voice information as a stream of typically-digitized data packets carried at a network layer (i.e. internet protocol layer). This stream of data packets is re-assembled and converted as analog voice at a packet destination.

Conventional and existing applications of IP telephony primarily involve voice-to-voice communications in real-time. Companies such as Net2Phone and Skype provide commercially-scalable IT infrastructure to support telephone calls over the Internet. IP telephony can further be utilized to provide conventional phone-to-phone communications instead of IP telephony for computer systems and networked devices.

A great business potential and communication efficiency may be realized if IP telephony is further intricately integrated to electronic transactions other than pure voice-to-voice communication applications. The present invention captures novel concepts for integrated application of IP telephony and electronic transactions and services.

SUMMARY

A network-based text-to-speech TagToe alert system is configured to remind one or more telephone call recipients scheduled TagToe information at a specific time slot. The network based text-to-speech alert system comprises an application software with a TagToe plug-in installed, wherein the application software is configured to open a TagToe user interface, a group of information entered into the TagToe user interface and/or selected by a user, wherein the group of information includes the specific time slot a computer system configured to store some or all portion of the group of information entered into the TagToe user interface and/or selected by the user, a text-to-speech conversion program configured to produce a voice reminder from some or all portion of the group of information entered into the TagToe user interface and/or selected by the user, wherein the voice reminder becomes some or all portion of the scheduled TagToe information, and a TagToe alert scheduler configured to initiate one or more telephone calls to the one or more telephone call recipients at the specific time slot, wherein the one or more telephone calls triggered by the TagToe alert scheduler delivers the scheduled TagToe information.

Furthermore, a method of transmitting scheduled TagToe information to one or more telephone call recipients is disclosed. The method comprises opening up a TagToe user interface from a software application, entering and/or selecting desired reminder information using the TagToe user interface, wherein the desired reminder information includes a specific TagToe delivery time slot, converting some portions of the desired reminder information entered and/or selected in the TagToe user interface from text to voice to create voice TagToe data using a text-to-speech conversion program, formulating the scheduled TagToe information by using the voice TagToe data and/or other relevant information to the software application, scheduling one or more telephone call deliveries of the scheduled TagToe information by using the specific TagToe delivery time slot, and triggering the one or more telephone call deliveries of the scheduled TagToe information on the specific TagToe delivery time slot to the one or more telephone call recipients, wherein the scheduled TagToe information is delivered as voice.

Moreover, a TagToe-enabled online calendar system is configured to remind one or more telephone call recipients scheduled TagToe information at a specific time slot. The TagToe-enabled online calendar system comprises an online calendar interface for scheduling meetings, appointments, and reminders, wherein the online calendar interface is TagToe-enabled and is configured to open a TagToe user interface, a group of information entered into the TagToe user interface and/or selected by a user, wherein the group of information includes the specific time slot, a computer system configured to store some or all portion of the group of information entered into the TagToe user interface and/or selected by the user, a text-to-speech conversion program configured to produce a voice reminder from some or all portion of the group of information entered into the TagToe user interface and/or selected by the user, wherein the voice reminder becomes some or all portion of the scheduled TagToe information, and a TagToe alert scheduler configured to initiate one or more telephone calls to the one or more telephone call recipients at the specific time slot, wherein the one or more telephone calls triggered by the TagToe alert scheduler delivers the scheduled TagToe information.

DETAILED DESCRIPTION

Figure 1:
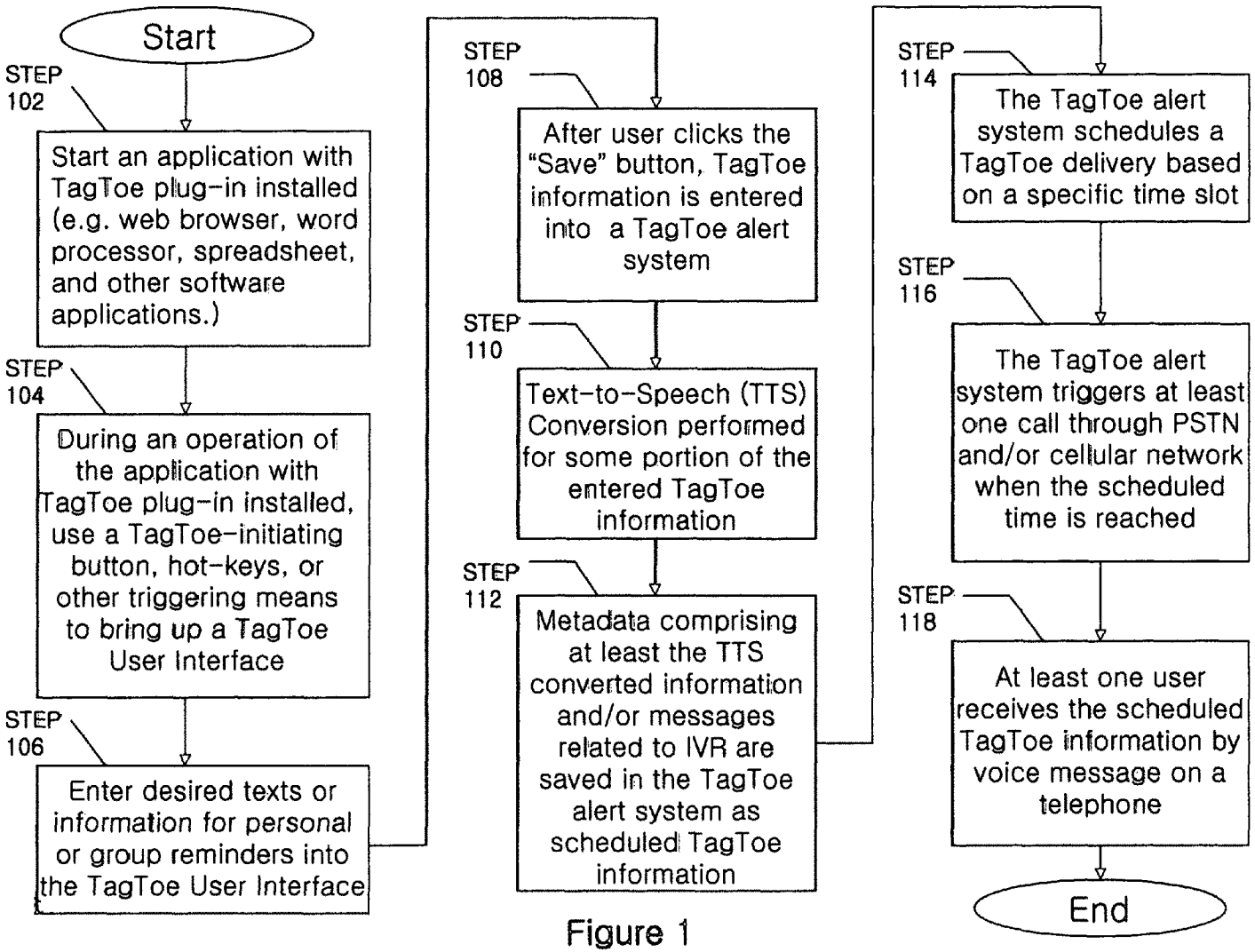
FIG. 1 shows a first flowchart for an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention relate to integrated IP telephony and electronic transactions and services. More specifically, embodiments of the invention are related to using text-to-speech-converted reminders for integrated IP telephony and electronic online services and applications.

Even with ubiquity of the Internet for text-based electronic communication methods such as the world wide web and emails in today's world, voice communications enabled by IP telephony hold some key potential advantages in online scheduling, meeting reminders, e-commerce transaction services, and any other time-sensitive or time-defined services.

For example, conventional e-mail reminders are frequently missed because a computer user may not be sitting in front of a computer accessing a particular web-mail site or an email program. Therefore, an important client-related e-mail meeting reminder may be neglected and forgotten if the computer user either does not have a computer access or forgets to access email box some time prior to the actual meeting time. Likewise, shopping items placed on a "wish list" of an Internet store could be forgotten by a shopper accidentally, which results in substantial loss of "realizable" revenue by the Internet store.

Furthermore, other text-based reminders such as text messages (e.g. SMS) to cell phones are frequently ignored nowadays because numerous marketing text messages inundate a cell phone user's text mail box at any given day.

In contrast, if text-to-speech-converted voice reminder services are integrated in a variety of Internet web services to call a cell phone or a landline telephone, they provide unique and novel enablement of proactive reminders and services to call recipients. The passive aspects of text-based reminders, as explained previously, directly contrast the proactive aspects of voice reminder services.

The potential and the promise of integrating text-to-speech-converted voice reminder services to Internet web services are compelling. Observations of human and electronic device interactions suggest that most users are likely to pick up a phone to receive calls if they are present and available. On the other hand, text-based reminders are often too passive as a reminding tool because they are frequently forgotten or neglected at the time of receipt due to a lack of computer access or sometimes a lack of attention.

The present invention discloses a computer network-based text-to-speech "TagToe" alert system. For the purpose of this specification and claims, the term "TagToe" is defined as a time-triggered voice alert system which converts some textual information to voice data and schedules voice calls to one or more intended recipients at a specified time slot. TagToe can be used as a standalone web service, as a plug-in application to a plurality of software applications, or as integrated business applications to Internet stores or web portal services.

FIG. 1 shows a flowchart for a TagToe-enabled software application operatively connected to a TagToe alert system in accordance with an embodiment of the invention. In this particular embodiment of the invention, a user starts a software application with TagToe plug-in installed, as shown in STEP 102. The software application can be a web browser, a word processor program, a spreadsheet program, or any other conventional software applications. Then, during an operation of the software application with TagToe plug-in installed, the user can initiate a TagToe reminder by clicking on a TagToe button, a hot-key designated for TagToe, or any other TagToe triggering means to bring up a TagToe user interface, as shown in STEP 104.

In STEP 106, the user enters and/or selects desired texts or a group of information in the TagToe user interface. In one embodiment of the invention, a specific time slot for a TagToe reminder transmission to one or more call recipients is entered or chosen in the TagToe user interface by the user. Then, the user typically clicks an "Okay" or a "Save" button to store the entered and/or the selected information into a data storage in a TagToe alert system, as shown in STEP 108. In one embodiment of the invention, the data storage is a main TagToe reminder server remotely connected to the user's computer via a computer network. In another embodiment of the invention, the data storage is simply a local information storage medium, such as a hard disk or a solid-state non-volatile memory contained in the user's computer.

Continuing with FIG. 1, the TagToe alert system operatively connected to the TagToe-enabled software application performs text-to-speech (TTS) conversion on some or all portions of the entered and/or the selected text information, as shown in STEP 110. Then, in one embodiment of the invention, metadata comprising the text-to-speech converted information and/or other information related to a particular software application, online services, users, or TagToe recipients are saved in the TagToe alert system, as shown in STEP 112. Examples of "other information" related to a particular software application, online services, users, or TagToe recipients include interactive voice response (IVR) which is configured to allow TagToe recipients to make selections for services provided by the particular software application or online services.

In another embodiment of the invention, STEP 112 is simply skipped and only the text-to-speech converted information from STEP 110 is saved in the TagToe alert system as a finalized TagToe reminder for a scheduled call delivery.

After text-to-speech (TTS) conversion and storing of the converted voice data in the TagToe alert system, the TagToe alert system schedules a TagToe delivery based on a specific time slot, as shown in STEP 114. In one embodiment of the invention, the specified time slot for a TagToe reminder transmission is entered or chosen by the user in STEP 106 and the specified time is fetched by the TagToe alert system to schedule a delivery. Then, in STEP 116, the TagToe alert system triggers at least one call through a public-switched telephone network (PSTN) and/or cellular phone network when a scheduled delivery time is reached. In one embodiment of the invention, the call transmission at least partly uses voice-over-IP (VoIP) technology for TagToe reminder deliveries. In STEP 118, at least one intended recipient receives a TagToe reminder by voice telephone call containing at least some portion of the TagToe information originally entered and/or selected by the user.

Figure 2:
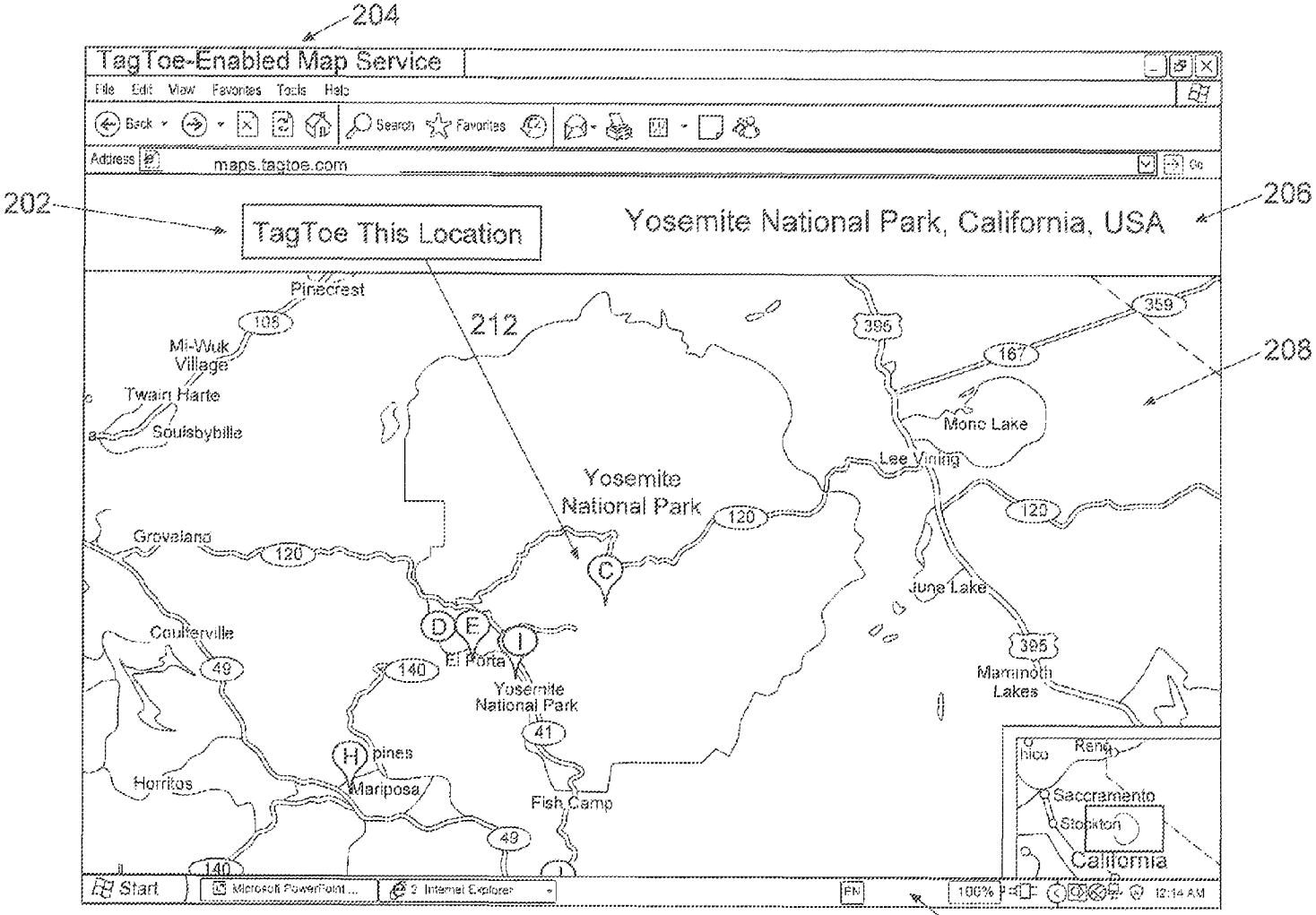
FIG. 2 shows a screenshot of a first software application using an embodiment of the invention.

FIG. 2 shows a first screenshot for a first practical example of a TagToe-enabled application utilizing the TagToe alert system. In this example, the TagToe-enabled application is a web browser (200) accessing an online map service site (204). In one embodiment of the invention, the web browser (200) is running within a Microsoft Windows operating system environment (210). A TagToe-initiating button (202) is embedded in the online map service site (204) or embedded in the web browser (200) itself as a plug-in application. The online map service site (204) is currently showing vicinities surrounding Yosemite National Park in California, as shown by the map location indicator (206). The map area field (208)

contains many points of interest, roads, geographic designations, and other relevant information.

In the first screenshot, the TagToe-initiating button (202) is pointing to a point of interest "C" by using an arrow (212) in the map area field (208). In one embodiment of the invention, a web browser user can simply move the arrow (212) to a particular point of interest within the map area field (208) to pinpoint a desired location.

Figure 3:
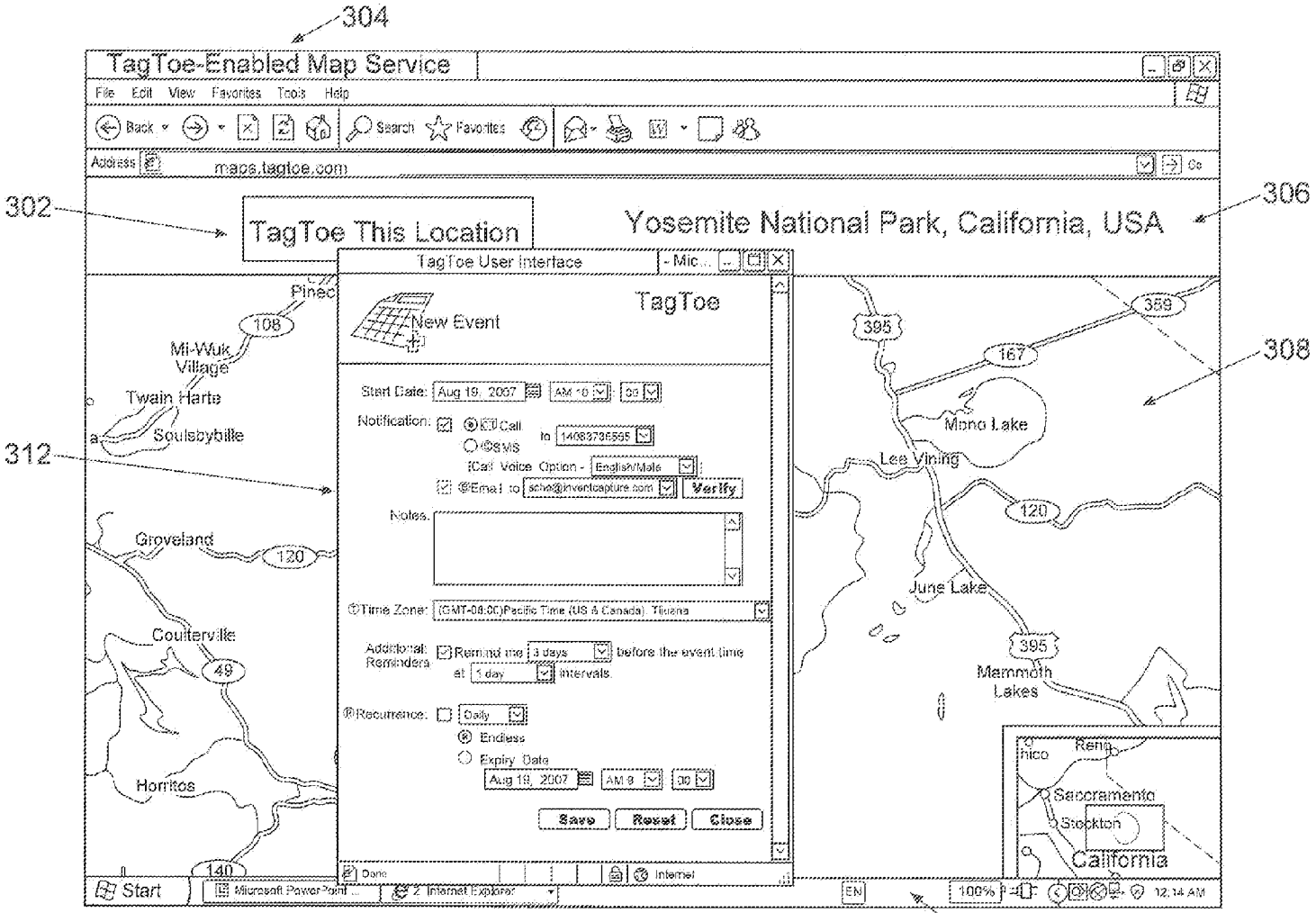
FIG. 3 shows another screenshot of the first software application using an embodiment of the invention.

FIG. 3 shows a second screenshot for the first practical example of the TagToe-enabled application utilizing the TagToe alert system. In the second screenshot shown in FIG. 3 following the first screenshot shown in FIG. 2, the web browser user clicks on the TagToe-initiating button (302) to bring a TagToe user interface (312). Because the TagToe-initiating button (302) pointed to the point of interest "C" by using the arrow (212) in the map area field (208) in the first screen, the TagToe user interface (312) automatically integrates geographic information related to the point of interest "C" as a "location to remind people" or as a meeting location.

Figure 4:
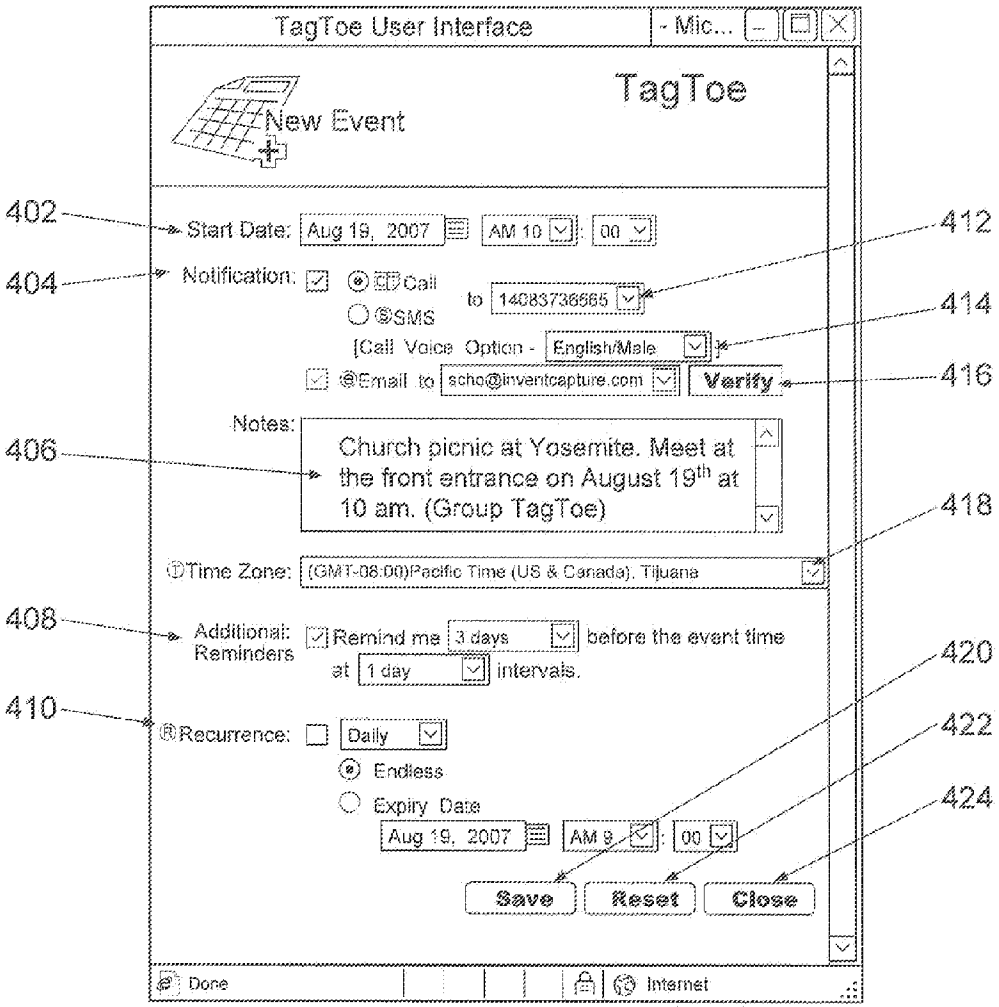
FIG. 4 shows another screenshot of the first software application using an embodiment of the invention.

FIG. 4 shows a third screenshot for the first practical example of the TagToe-enabled application utilizing the TagToe alert system. In the third screenshot shown in FIG. 4, an example of detailed fields for the TagToe user interface (400) is displayed. In one embodiment of the invention, the web browser user accessing the online map service site (204) can choose a meeting time or a TagToe reminder time slot (402). The web browser user can also select several modes of reminders, including a TagToe reminder call to an intended recipient (412), an SMS message, or an email. More than one recipient can receive a variety of different types of reminders depending on the user input. For TagToe reminder voice options, the web browser user accessing the online map service site (204) can also choose types of voices and languages. In one embodiment of the invention, an internal translation program can translate one language to another during text-to-speech conversion process. Therefore, if a recipient's preferred language profile is Spanish instead of English, then English textual messages originally-entered into a TagToe-enabled application can be converted to a Spanish voice message during the text-to-speech conversion process before the TagToe alert system schedules a TagToe reminder for delivery.

Continuing with FIG. 4, an email verification button (416) ensures that an email notification does not bounce back due to an incorrect email address. In this example, the web browser user enters Church picnic information for a group meeting in Yosemite for a specific time in a text-entry field (406). Information entered into the text-entry field (406) can go through text-to-speech conversion process later for TagToe reminders (i.e. text-to-speech voice message delivery) to one or more desired telephone call recipients.

In the TagToe user interface (400), a time zone field (418) allows the web browser user to use a desired time zone for meeting reminder scheduling and delivery. The web browser user can also add additional reminders (408) by specifying a recurring reminder interval and/or an additional reminder date prior to the meeting time (402). Further field selection for recurring reminders can be made by configuring recurrence fields (410).

Continuing with FIG. 4, the entered and the selected fields can be saved, reset, or closed by using a "Save" button (420), a "Reset" button (422), or a "Close" button (424). In this particular example, if the "Close" button (424) or the "Reset" button (422) is selected, the web browser user may be asked to confirm saving field information prior to closing the TagToe user interface (400).

If the field information is saved through the TagToe user interface (400), the TagToe alert system performs necessary text-to-speech conversion and schedules TagToe reminder deliveries, email notifications, and/or SMS messages to one or more intended recipients. The first practical example of TagToe-enabled application utilizing the TagToe alert system showcases how the online map service site (204) can provide an integrated IP telephony and web service experience to end users. In this particular example, the TagToe technology provides means of text-to-speech (TTS) voice meeting reminders to intended recipients using their telephone numbers. By inherently integrating map location service and its address information to group "TagToe" meeting reminders initiated by at least one web browser user, the online map service site (204) is able to provide an advanced level of proactive location and meeting reminders to TagToe recipients.

Figure 5:
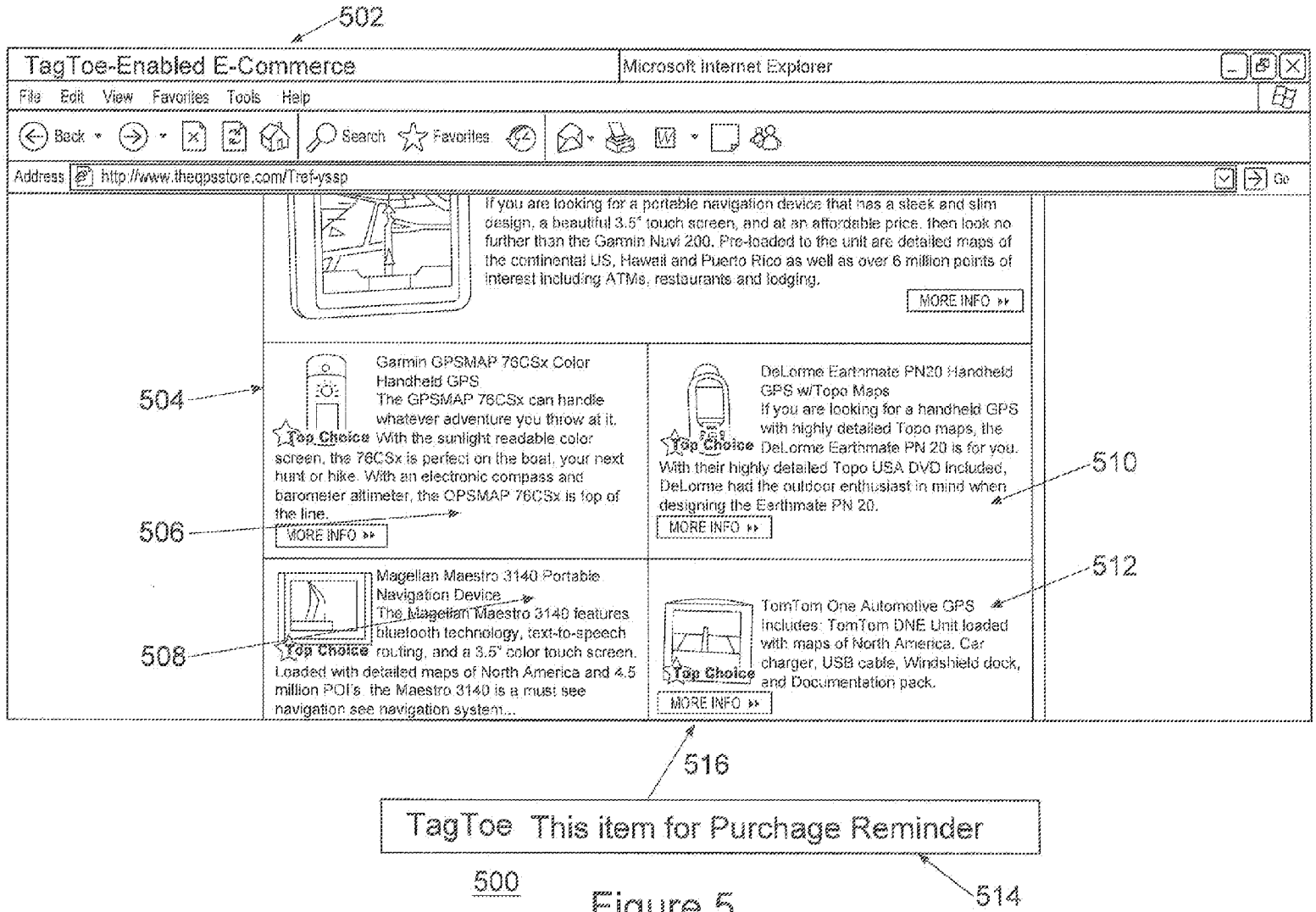
FIG. 5 shows a screenshot of a second software application using an embodiment of the invention.

FIG. 5 shows a first screenshot for a second practical example of the TagToe-enabled application utilizing the TagToe alert system. In this example, the TagToe-enabled application is a web browser (500) accessing an online shopping site (502). In one embodiment of the invention, the web browser (500) is running within a Microsoft Windows operating system environment. In this particular example, the online shopping site shows a variety of GPS navigation systems (506, 508, 510, 512) in a online store content page (504).

A TagToe-initiating button (514) is embedded in the online shopping site (502) or embedded in the web browser (500) itself as a plug-in application. The TagToe-initiating button (514) has an arrow (516) to point to a particular product of interest. In this particular case, the user configured the arrow (516) to point to a GPS navigational unit (512). The second practical example showcasing the TagToe technology accommodates a TagToe purchase reminder for the online shopping site (502), which is more proactive than a conventional "wish list" or user-initiated email reminders. By providing proactive user-initiated voice reminders for a future purchase of a product, online stores can achieve substantial revenue increase by integrating the TagToe technology to e-commerce infrastructure. For example, an interactive voice response (IVR) system which is integrated with the TagToe technology and electronic transaction systems can provide a telephonic purchase of the "TagToe-ed" product after a simple identity authentication of a particular call recipient. In another example, the TagToe purchase reminder can be used simply as a self-reminder to a consumer that she or he needs to purchase a product, which motivates the consumer to log-in to an online store correlated to the TagToe purchase reminder to make a purchase.

Figure 6:
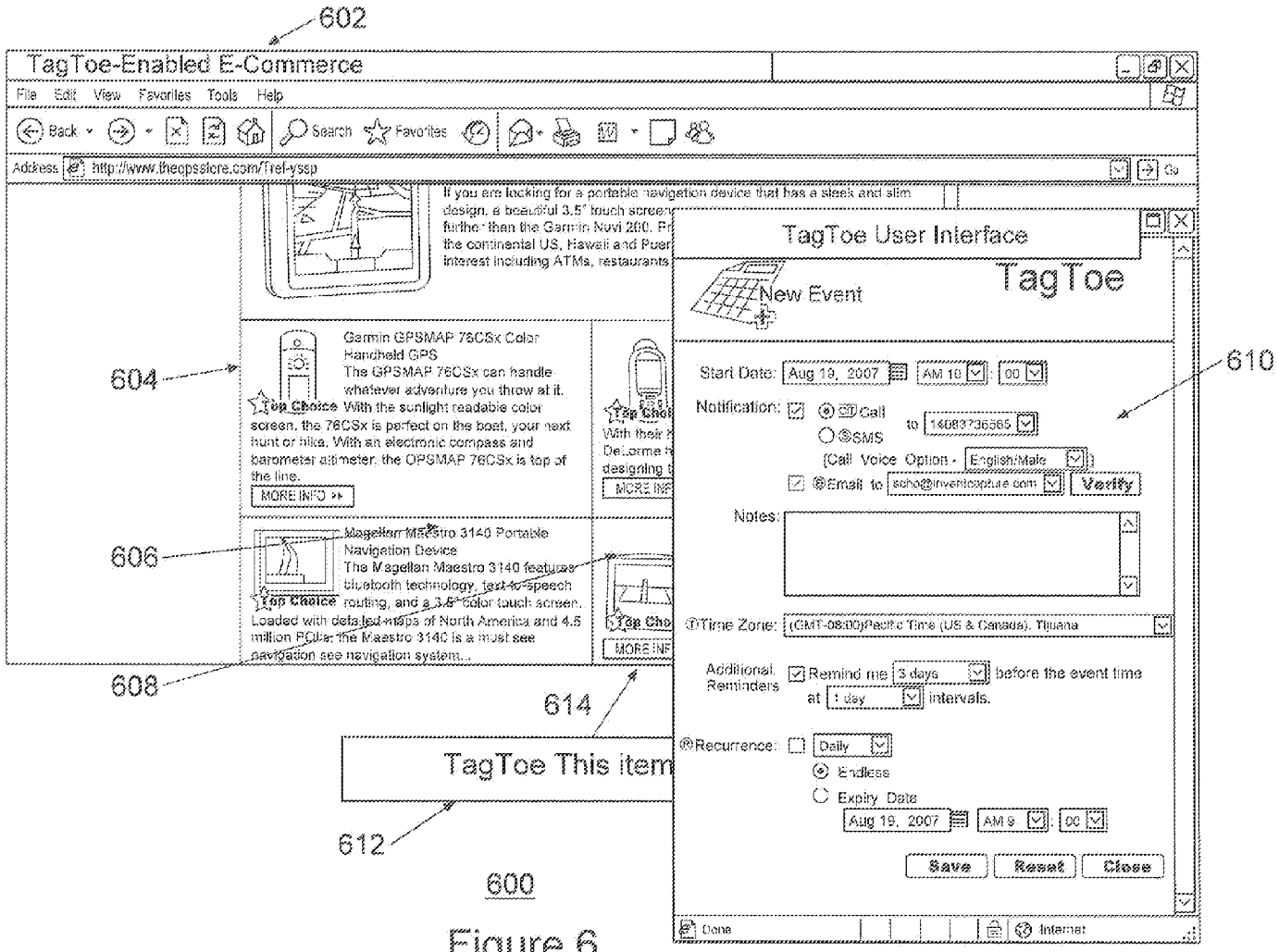
FIG. 6 shows another screenshot of the second software application using an embodiment of the invention.

FIG. 6 shows a second screenshot for the second practical example of the TagToe-enabled application utilizing the TagToe alert system. In the second screenshot shown in FIG. 6 following the first screenshot shown in FIG. 5 for the online shopping site (502), the web browser user clicks on a TagToe-initiating button (612) to bring a TagToe user interface (610). Because the TagToe-initiating button (612) pointed to the GPS navigation unit (512) by using the arrow (516) in the online shopping site (502) in FIG. 5, the TagToe user interface (610) automatically integrates product information related to a corresponding GPS navigation unit (608). In FIG. 6, the TagToe-initiating button (612) points to the corresponding GPS navigation unit (608) with an arrow (614). In one embodiment of the invention, an integration of product information to the TagToe technology in e-commerce IT infrastructure is sufficient to accommodate a rapid and efficient telephone-based purchase (e.g. an IVR system) when an intended call recipient receives a TagToe purchase reminder.

Figure 7:
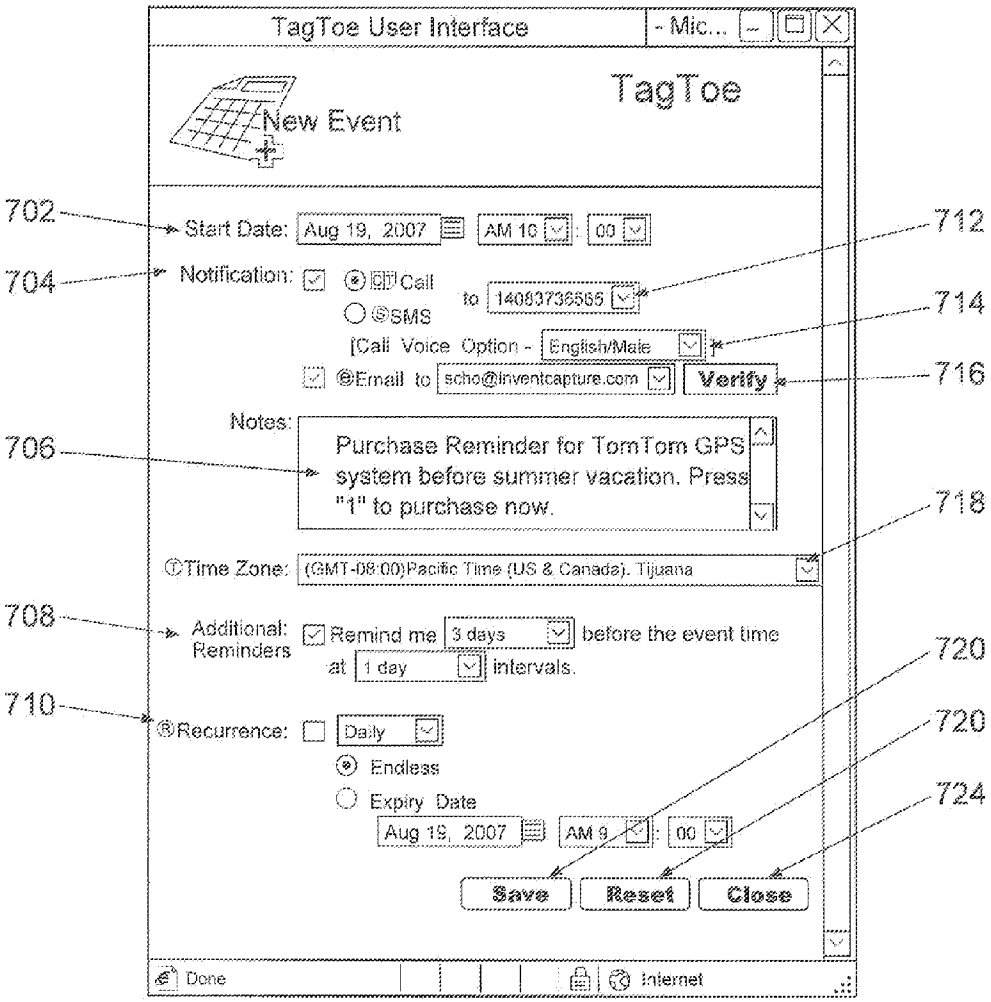
FIG. 7 shows another screenshot of the second software application using an embodiment of the invention.

FIG. 7 shows a third screenshot for the second practical example of the TagToe-enabled application utilizing the TagToe alert system. In the third screenshot shown in FIG. 7, an example of detailed fields for the TagToe user interface (700) is displayed. In one embodiment of the invention, the web browser user accessing the online shopping site (502) can choose a future purchase time or a purchase reminder time at a specified time slot (702). The web browser user can also select several modes of reminders, including a TagToe reminder call to an intended recipient (712), an SMS message, or an email. More than one recipient can receive a variety of different types of reminders depending on the user input. In one embodiment of the invention, TagToe purchase reminders generally require pre-TagToe authorizations by intended call recipients to avoid unauthorized telemarketing applications of the TagToe technology. For example, when the web browser user wants to add a telephone number as a TagToe recipient, the TagToe alert system first sends an authorization code to the telephone number for the call recipient authentication and authorization purposes. Other elaborate authentication and/or authorization schemes may be used to protect the privacy of prospective TagToe recipients. For TagToe reminder voice options, the web browser user accessing the online shopping site (502) can also choose types of voices and languages. In one embodiment of the invention, an internal translation program can translate one language to another during text-to-speech (TTS) conversion process. Therefore, if a recipient's preferred language profile is Spanish instead of English, then English textual messages originally-entered into a TagToe-enabled application can be converted to a Spanish voice message during the text-to-speech conversion process before the TagToe alert system schedules a TagToe reminder for delivery.

Continuing with FIG. 7, an email verification button (716) ensures that an email notification does not bounce back due to an incorrect email address. In this example, the web browser user enters a purchase reminder for a desired GPS system before his or her summer vacation for a specific time in a text-entry field (706). Information entered into the text-entry field (706) can go through text-to-speech conversion process later for TagToe reminders (i.e. text-to-speech voice message delivery) to one or more desired telephone call recipients.

In the TagToe user interface (700), a time zone field (718) allows the web browser user to use a desired time zone for meeting reminder scheduling and delivery. The web browser user can also add additional reminders (708) by specifying a recurring reminder interval and/or an additional reminder time prior to the meeting time (702). Further field selection for recurring reminders can be made by configuring recurrence fields (710).

Continuing with FIG. 7, the entered and the selected fields can be saved, reset, or closed by using a "Save" button (720), a "Reset" button (722), or a "Close" button (724). In this particular example, if the "Close" button (724) or the "Reset" button (722) is selected, the web browser user may be asked to confirm saving field information prior to closing the TagToe user interface (700).

If the field information is saved through the TagToe user interface (700), the TagToe alert system performs necessary text-to-speech conversion and schedules TagToe reminder deliveries, email notifications, and/or SMS messages to one or more intended recipients. The second practical example of TagToe-enabled application utilizing the TagToe alert system showcases how the online shopping site (502) can provide an integrated IP telephony and web service experience to end users. In this particular example, the TagToe technology provides means of text-to-speech (TTS) voice purchase reminders to intended recipients using their telephone numbers. In one embodiment of the invention, the TagToe technology is further integrated into the e-commerce IT infrastructure to provide means of immediate telephonic purchase of reminded items when the intended recipients receive TagToe reminders. By inherently integrating an e-commerce infrastructure, product information, and the TagToe technology, the online store site (502) is able to provide an advanced level of proactive purchase reminders and telephonic purchase methods to TagToe recipients.

Figure 8:
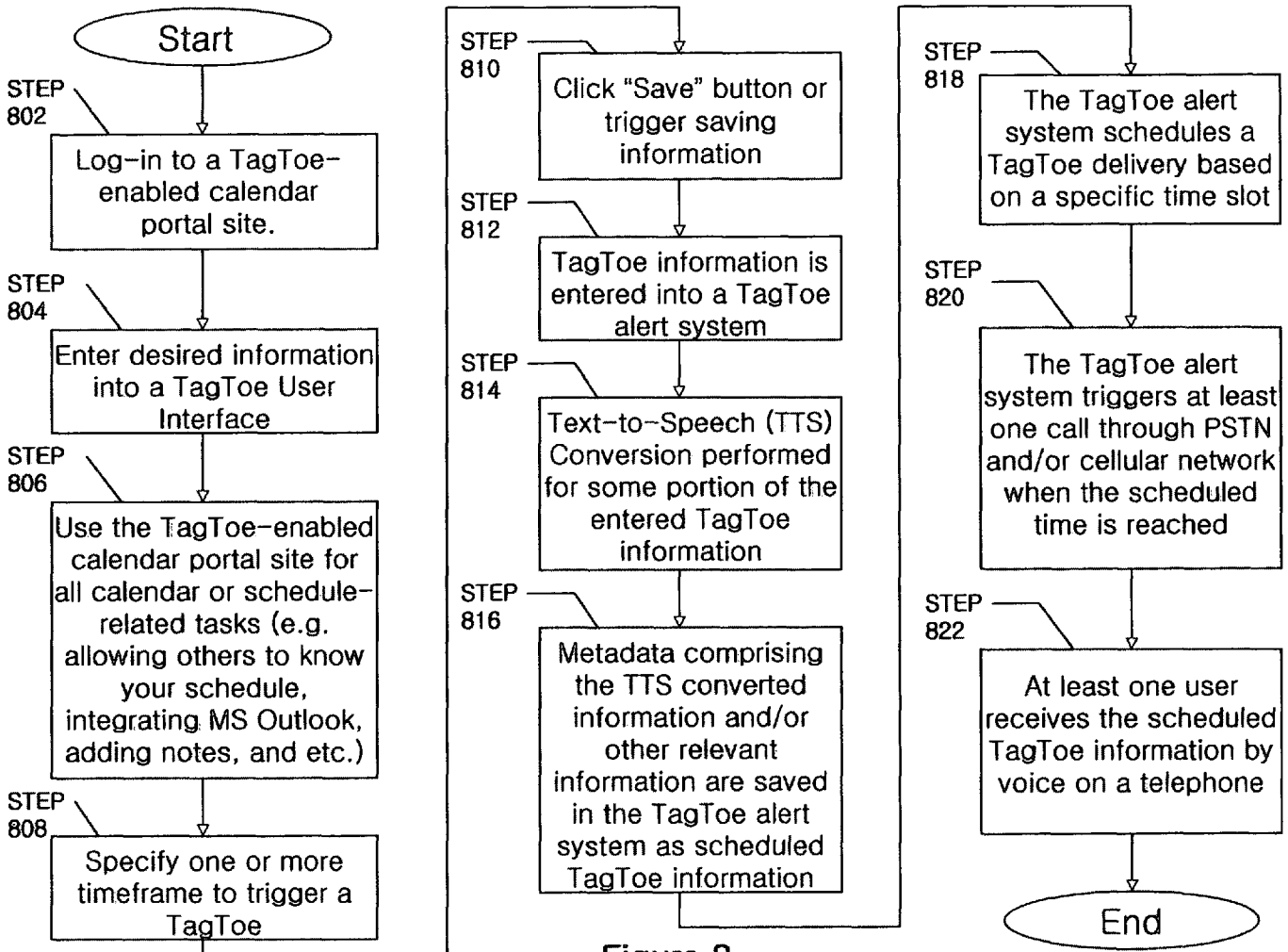
FIG. 8 shows a second flowchart for an embodiment of the invention.

FIG. 8 shows a flowchart for a TagToe-enabled calendar portal site operatively connected to a TagToe alert system in accordance with an embodiment of the invention. This is a preferred embodiment of the invention for the TagToe alert system. In this particular embodiment of the invention, a user logs-in to the TagToe enabled calendar portal site, as shown in STEP 802. Then, the user can either first enter and/or select desired information into a TagToe user interface, as shown in STEP 804, or first use the TagToe-enabled calendar portal site for calendar or scheduling-related tasks, as shown in STEP 806. The order of flow for STEP 804 and STEP 806 is interchangeable (i.e. STEP 806 can precede STEP 804). In one embodiment of the invention, for STEP 804, the user can bring up a TagToe user interface by clicking on a TagToe button, a hot-key designated for TagToe, or any other TagToe user interface triggering means. In another embodiment of the invention, the user can trigger a "new event" from the calendar portal site to bring up a TagToe user interface.

In STEP 804, the user enters and/or selects desired texts or a group of information in the TagToe user interface. In one embodiment of the invention, a specific time slot for a TagToe reminder transmission to one or more call recipients is entered or chosen in the TagToe user interface by the user.

In STEP 806, the user utilizes the TagToe-enabled calendar portal site for calendar or scheduling related tasks. Examples of the calendar or scheduling related tasks include adding notes to one's schedule, configuring schedule-view authorizations for other users, and arranging meetings with others. As stated previously, STEP 806 can precede STEP 804 in some cases. As an optional step, the user can specify one or more timeframe to trigger a TagToe reminder by entering and/or selecting information in the TagToe user interface, as shown in STEP 808.

Then, the user typically clicks an "Okay" or a "Save" button to store the entered and/or the selected information into a data storage in a TagToe alert system, as shown in STEP 810 and STEP 812. In one embodiment of the invention, the data storage is a main TagToe reminder server remotely connected to the user's computer via a computer network. In another embodiment of the invention, the data storage is simply a local information storage medium, such as a hard disk or a solid-state non-volatile memory contained in the user's computer.

Continuing with FIG. 8, the TagToe alert system operatively connected to the TagToe-enabled calendar portal site performs text-to-speech (TTS) conversion on some or all portions of the entered and/or the selected text information, as shown in STEP 814. Then, in one embodiment of the invention, metadata comprising the text-to-speech converted information and/or other relevant information are saved in the TagToe alert system, as shown in STEP 816. Examples of "other relevant information" include interactive voice response (IVR) which is configured to allow TagToe recipients to make selections for available services such as a teleconference call among a plurality of TagToe recipients.

In another embodiment of the invention, STEP 816 is simply skipped and only the text-to-speech converted information from STEP 814 is saved in the TagToe alert system as a finalized TagToe reminder for a scheduled call delivery.

After text-to-speech (TTS) conversion and storing of the converted voice data in the TagToe alert system, the TagToe alert system schedules a TagToe delivery based on a specific time slot, as shown in STEP 818. In one embodiment of the invention, the specified time slot for a TagToe reminder transmission is entered or chosen by the user in STEP 804 and the specified time is fetched by the TagToe alert system to schedule a delivery. Then, in STEP 820, the TagToe alert system triggers at least one call through a public-switched telephone network (PSTN) and/or cellular phone network when a scheduled delivery time is reached. In one embodiment of the invention, the call transmission at least partly uses voice-over-IP (VoIP) technology for TagToe reminder deliveries. In STEP 822, at least one intended recipient receives a TagToe reminder by voice telephone call containing at least some portion of the TagToe information originally entered and/or selected by the user.

Figure 9:
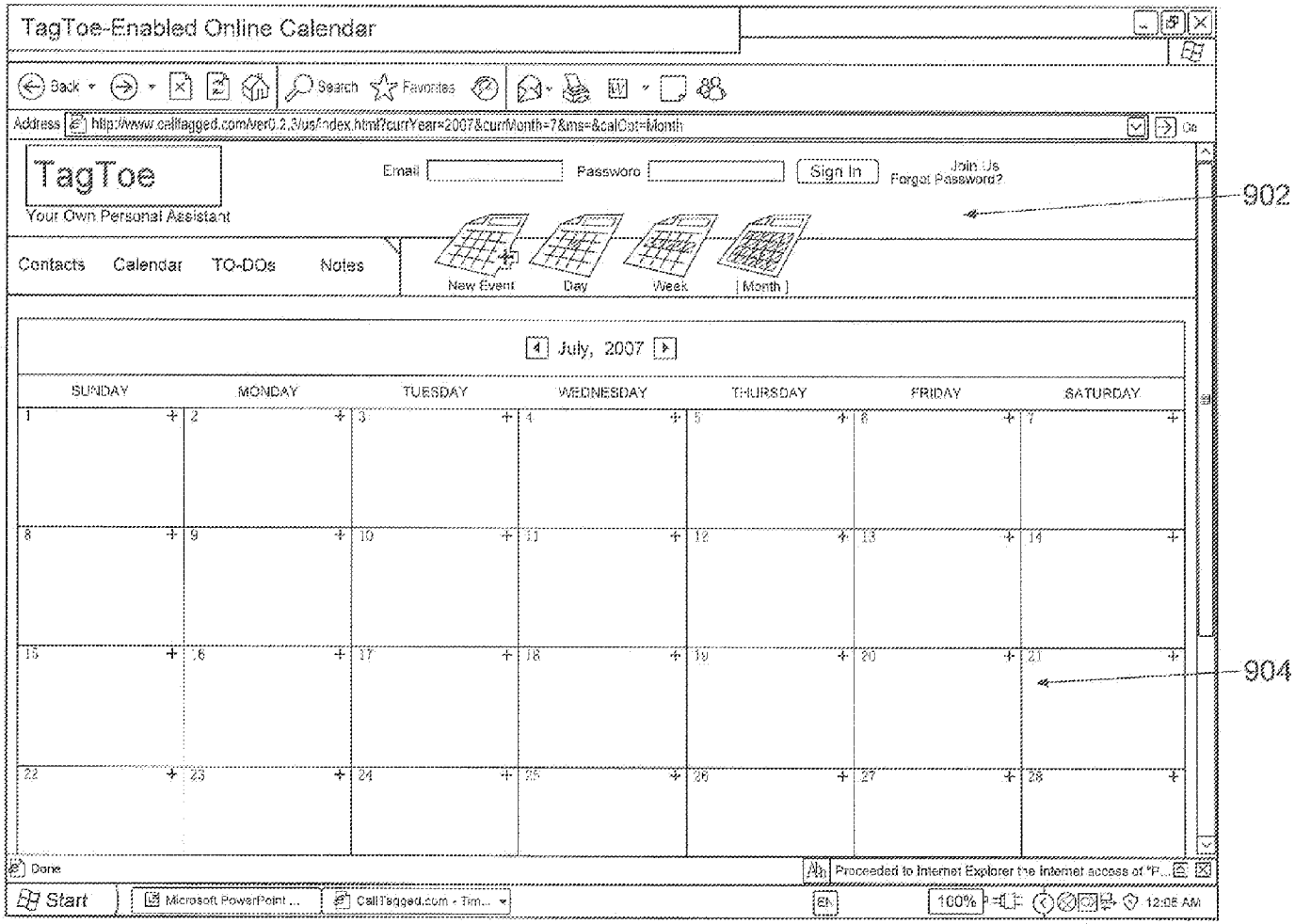
FIG. 9 shows a screenshot of a third software application using an embodiment of the invention.

FIG. 9 shows a first screenshot of a TagToe-enabled calendar portal site (900). In one embodiment of the invention, the TagToe-enabled calendar portal site (900) has a menu selection section (902) and an calendar event entry section (904). The menu selection section (902) can contain any features and/or services suitable for online calendar and scheduling functions, including contact lists, note pads, and calendar views by day, week, and month. In one embodiment of the invention, the calendar event entry section (904) opens up a TagToe user interface when a "+" button is clicked on the calendar event entry section.

Figure 10:
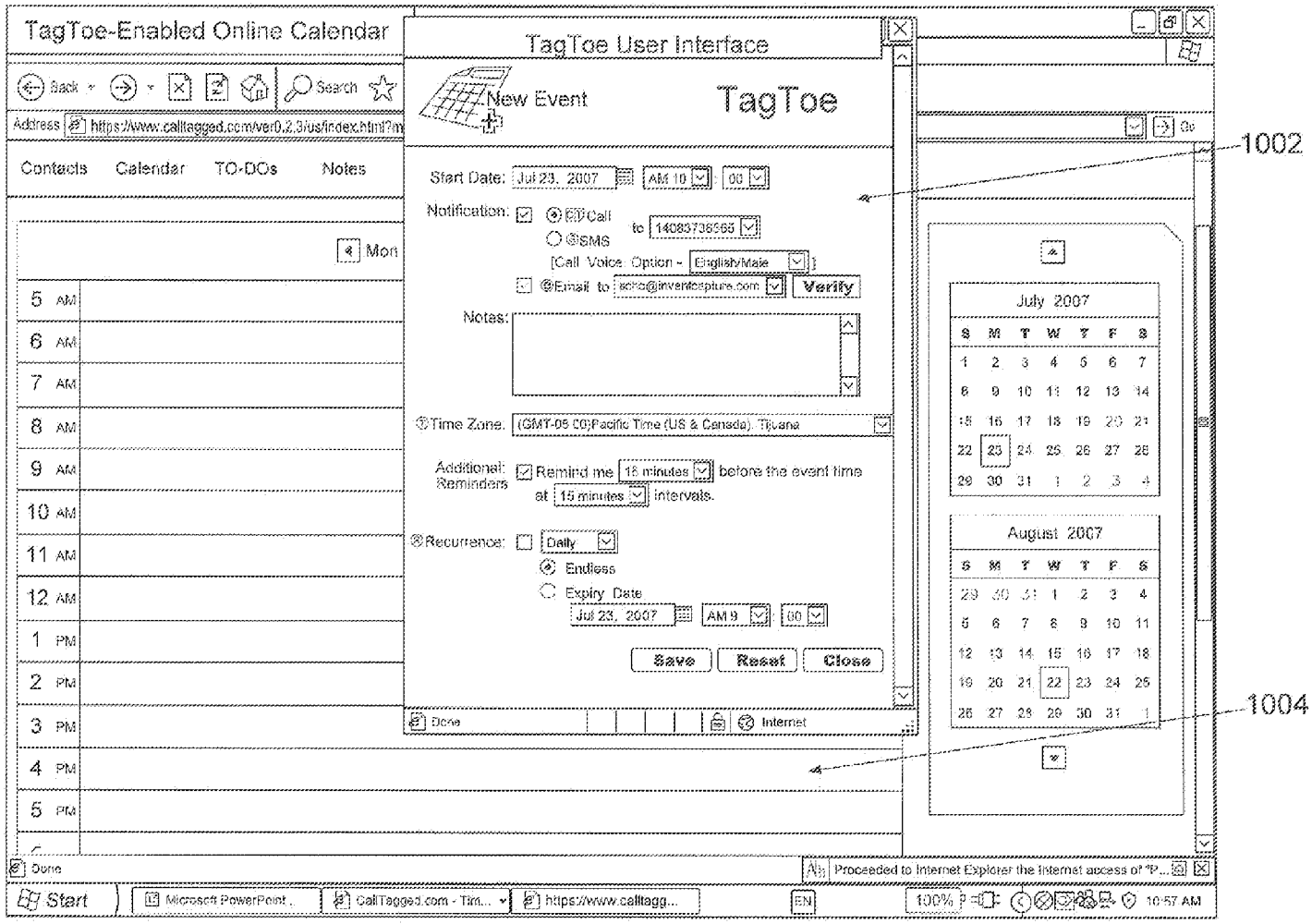
FIG. 10 shows a screenshot of the third software application using an embodiment of the invention.

FIG. 10 shows a second screenshot of the TagToe-enabled calendar portal site (1000). In one embodiment of the invention, when a user clicks on the "+" button from the calendar event entry section (904) from FIG. 9, a TagToe user interface (1002) is triggered for entering notes and setting TagToe reminders at a particular time slot. If the user saves entered notes and TagToe reminder settings in the TagToe user interface (1002), a corresponding time slot in the calendar event entry section will reflect the entered notes and/or the TagToe reminder settings. When a scheduled time slot is reached based on the TagToe reminder settings, an TagToe alert system operatively connected to the TagToe-enabled portal site can trigger a telephone call to deliver the entered notes or other relevant online scheduling information to at least one intended TagToe recipients. Intended TagToe recipients typically include the user who wrote and saved notes in the TagToe user interface (1002) for future text-to-speech delivery of the saved notes.

In one embodiment of the invention, the TagToe-enabled calendar portal site is further configured to accommodate conference calls among several TagToe recipients. An interactive voice response (IVR) system can be utilized to give each TagToe recipient an opportunity to participate in one or more conference calls.

Figure 11:
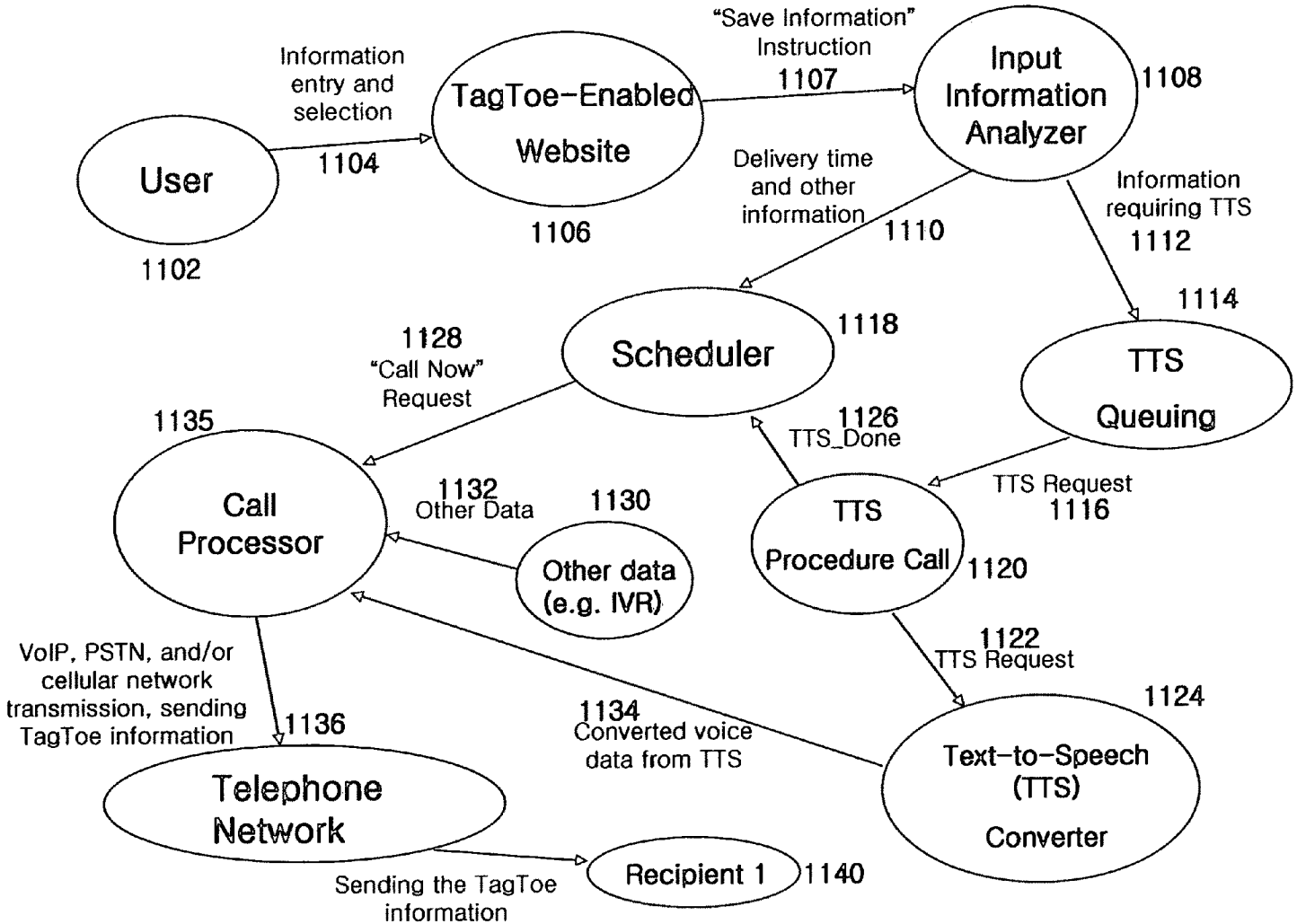
FIG. 11 shows a system configuration diagram in accordance with an embodiment of the invention.

FIG. 11 shows a system configuration diagram for a TagToe alert system in accordance with an embodiment of the invention. In this particular implementation of the invention, a user (1102) enters and/or selects information (1104) on a TagToe-enabled website (1106), typically utilizing a TagToe user interface. When the user (1102) further gives "Save Information" or an equivalent instruction to the TagToe-enabled website (1106) after making entries or selections to the TagToe user interface, an input information analyzer (1108) parses, categorizes, stores, and analyzes the input information (1104) from the user (1102). Then, the input information analyzer (1108) sends delivery time slot(s) and other relevant information (1110) to a TagToe scheduler (1118). The input information analyzer (1108) also sends categorized information (1112) requiring text-to-speech (TTS) conversion to a TTS queuing block (1114). Multiple number of instructions requiring TTS conversion can be queued into the TTS queuing block (1114).

The TTS queuing block (1114) sends a TTS request (1116) to a TTS procedure call (1120). The TTS procedure call (1120) is responsible for "pushing" a TTS request (1122) to a TTS converter (1124), which typically processes TTS requests (1122) serially. It is feasible within this embodiment of the invention that a multiple number of TTS converters is connected to the TagToe alert system for faster parallel processing of TTS conversions.

Continuing with FIG. 11, the TTS procedure call (1120) sends a "TTS_Done" signal (1126) related to a particular TTS conversion to the TagToe scheduler (1118) once the particular TTS conversion is complete. The "TTS_Done" signal (1126) informs that the TagToe scheduler (1118) is now authorized to proceed with a with a "Call Now" request (1128) at a scheduled time slot because the particular TTS conversion related to a TagToe reminder is complete. The TTS converter (1124) is configured to send converted voice data to a call processor (1135) directly. The call processor (1135) also optionally receives "other data" (1132) such as interactive voice response (IVR) data (1130) from e-commerce or customer relationship management IT infrastructures. In one embodiment of the invention, a script language provides IVR data (1132) to the call processor (1135).

The call processor (1135) is capable of gathering call scheduling information from the TagToe scheduler (1118), the TTS converter (1124), and the "other data" block (1130) to make a coherently-organized TagToe telephone call (1138) to at least one intended TagToe recipient (1140) via a telephone network (1136).

Figure 12:
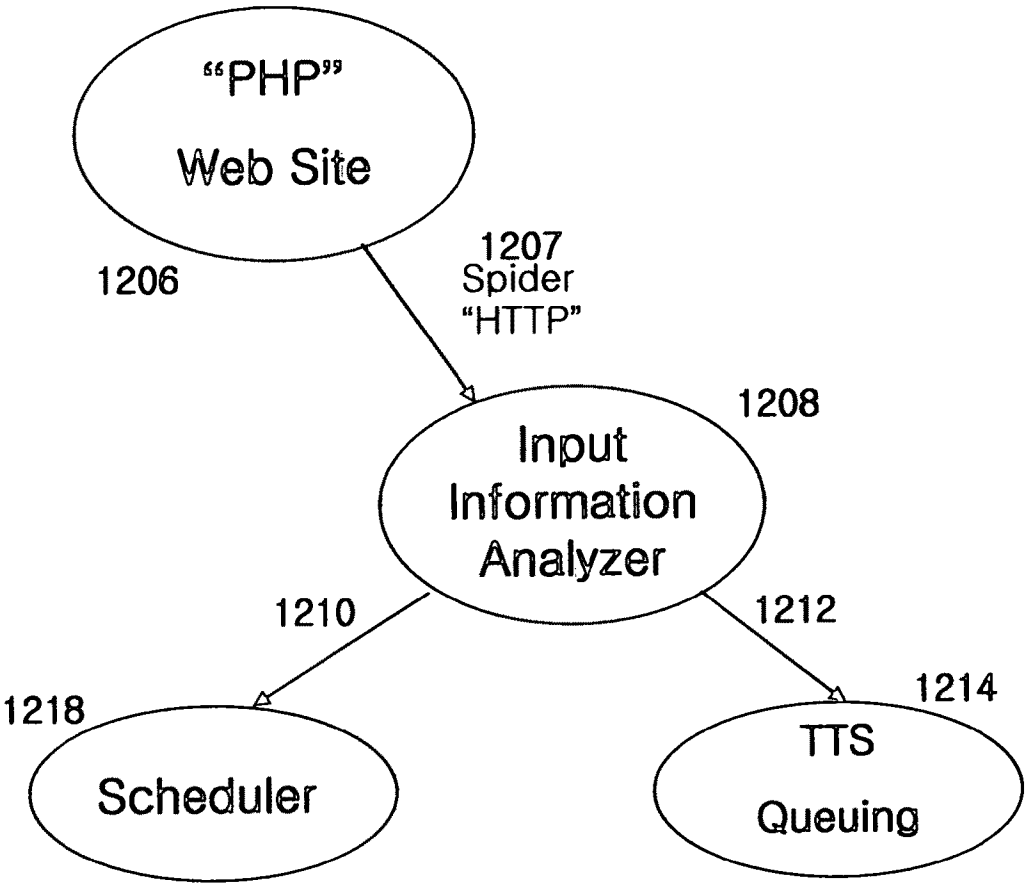
FIG. 12 shows a first subset of the system configuration diagram in accordance with an embodiment of the invention.

FIG. 12 shows an embodiment of a front-end of a TagToe alert system based on the system configuration diagram of FIG. 11. In this example, a TagToe-enabled website (1106) of FIG. 11 is a "PHP" website (1206) which transmits data to an input information analyzer (1208) by using "HTTP" spiders (1207). The input information analyzer (1208) is capable of parsing, categorizing, storing, and analyzing incoming input information to send appropriately-processed information to a TagToe scheduler (1218) and a TTS queuing block (1214). It should be noted that there are many forms of implementing the front-end of the TagToe alert system and FIG. 12 is merely one example of many possibilities and combinations.

Figure 13:
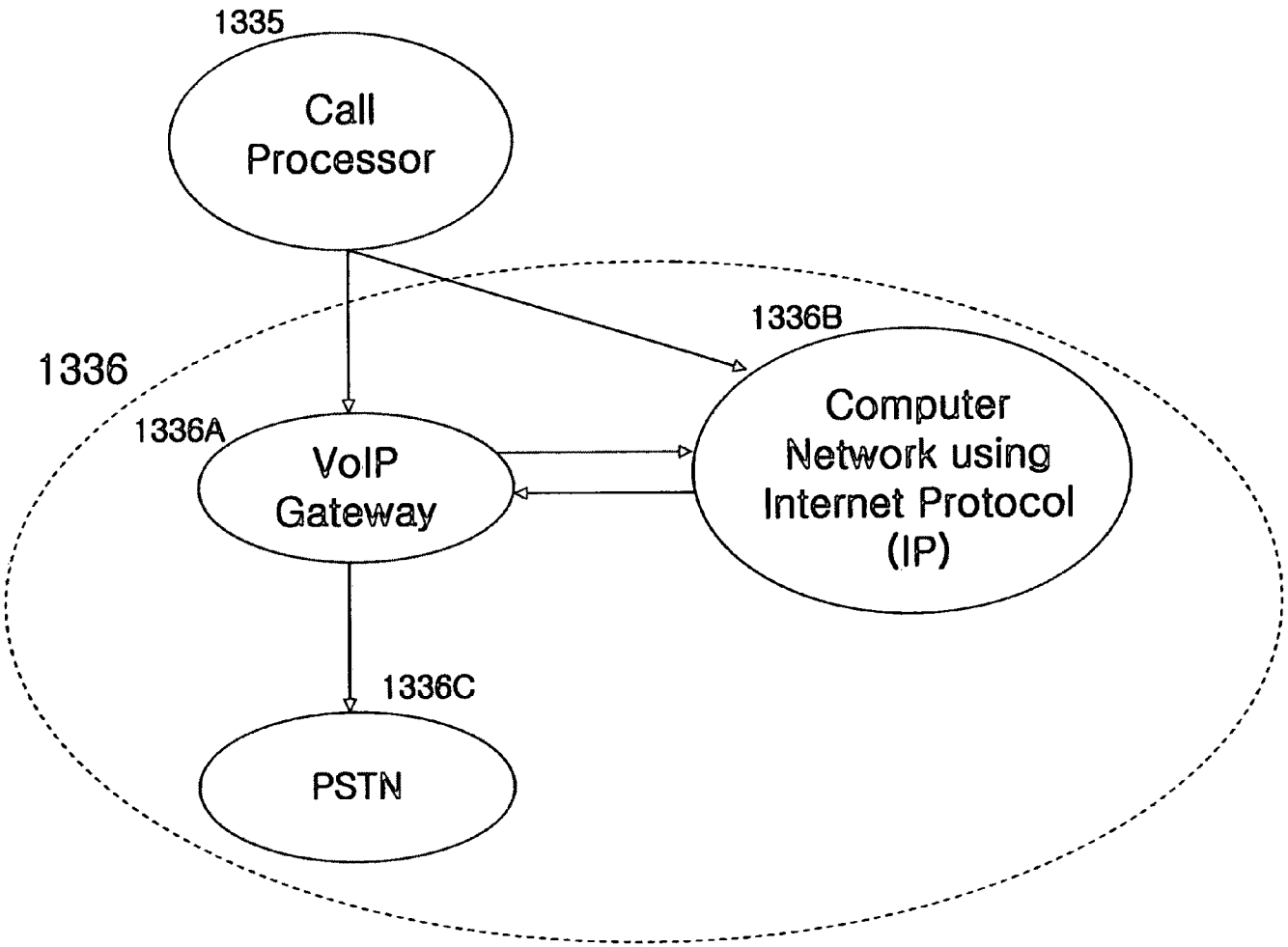
FIG. 13 shows a second subset of the system configuration diagram in accordance with an embodiment of the invention.

FIG. 13 shows an embodiment of a call processor (1335) and a telephone network (1336) based on the system configuration diagram of FIG. 11. In this example, the telephone network (1136) of FIG. 11 comprises three elements: a voice-over-IP gateway (1336A), a computer network using internet protocol (1336B), and a public-switched telephone network, or PSTN (1336C). In one embodiment of the invention, the voice-over-IP gateway (1336A) acts as an efficient interface between "packetized" IP voice data traveling on the computer network using internet protocol (1136B) and telephone voice data traveling through the public-switched telephone network (1136C). The call processor (1335) can incorporate an internet protocol (IP) or hybrid PBX to switch calls, manage routes, and connect callers with networks outside the internet protocol (IP) infrastructure. In one embodiment of the invention, the call processor (1335) is at least partly implemented with Asterisk, which is an open source telephony platform.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A network-based text-to-speech TagToe alert system configured to remind a user scheduled TagToe information at a specific time slot, the network based text-to-speech alert system comprising:

an application software with a TagToe program installed, wherein the application software is configured to open a TagToe user interface;

a group of information entered into the TagToe user interface and/or selected by the user, wherein the group of information specifies the specific time slot and a product or a service, which is tagged ("TagToe-ed") by the user for a user-self-scheduled purchase reminder;

a computer system configured to store some or all portion of the group of information entered into the TagToe user interface and/or selected by the user;

a text-to-speech conversion program configured to produce a voice-version of the user-self-scheduled purchase reminder from some or all portion of the group of information entered into the TagToe user interface and/or selected by the user, wherein the voice-version of the user-self-scheduled purchase reminder becomes some or all portion of the scheduled TagToe information and wherein the scheduled TagToe information also integrates e-commerce specific and product-specific information from an e-commerce infrastructure and an electronic transaction system to enable an interactive voice response (IVR)-based telephonic purchase of the product or the service previously tagged by the user; and a TagToe alert scheduler configured to initiate a telephone call to the user at the specific time slot, wherein the telephone call triggered by the TagToe alert scheduler delivers the scheduled TagToe information, and wherein the scheduled TagToe information includes the voice-version of the user-self-scheduled purchase reminder of the product or the service previously tagged by the user.

2. The network-based text-to-speech TagToe alert system of claim 1, wherein the application software is triggered by a TagToe-initiating button, a hot-key, or a user command to open the TagToe user interface.

3. The network-based text-to-speech TagToe alert system of claim 1, wherein the group of information entered into the TagToe user interface and/or selected by the user further includes contact information for at least one telephone call recipient.

4. The network-based text-to-speech TagToe alert system of claim 1, wherein the TagToe alert system is configured to accommodate a conference call among the user and other telephone call recipients after delivering the scheduled TagToe information to the user.

5. The network-based text-to-speech TagToe alert system of claim 1, wherein the group of information entered into the TagToe user interface and/or selected by the user further includes user-defined textual and/or multimedia information.

6. The network-based text-to-speech TagToe alert system of claim 1, wherein the application software with the TagToe program installed is an Internet web browser.

7. The network-based text-to-speech TagToe alert system of claim 1, wherein the scheduled TagToe information further comprises a text message, interactive voice response (IVR) information, and/or multimedia information.

8. The network-based text-to-speech TagToe alert system of claim 1, wherein the scheduled TagToe information further includes location-specific information which is in addition to the group of information originally entered into the TagToe user interface and/or selected by the user.

9. The network-based text-to-speech TagToe alert system of claim 1, wherein the TagToe alert scheduler is directly or indirectly connected to a public-switched telephone network (PSTN) and/or a mobile-phone service network.

10. A method of transmitting scheduled TagToe information to a user, the method comprising:

opening up a TagToe user interface from a software application;

entering and/or selecting desired reminder information using the TagToe user interface, wherein the desired reminder information includes a specific TagToe delivery time slot and a product or a service, which is tagged ("TagToe-ed") by the user for a user-self-scheduled purchase reminder;

converting some portions of the desired reminder information entered and/or selected in the TagToe user interface from text to voice to create a voice-version of the user-self-scheduled purchase reminder using a text-to-speech conversion program;

formulating the scheduled TagToe information by integrating the voice-version of the user-self-scheduled purchase reminder and/or other relevant information to the software application, wherein the voice-version of the user-self-scheduled purchase reminder integrates e-commerce specific and product-specific information from an e-commerce infrastructure and an electronic transaction system to enable an interactive voice response (IVR)-based telephonic purchase of the product or the service previously tagged by the user;

scheduling a telephone call delivery of the scheduled TagToe information by using the specific TagToe delivery time slot; and triggering the telephone call delivery of the scheduled TagToe information on the specific TagToe delivery time slot to the user, wherein the scheduled TagToe information is delivered as voice.

11. The method of claim 10, further comprising a step of sending a text message and/or a multimedia message to the user, wherein the text message and/or the multimedia message contains at least some portion of the desired reminder information.

12. The method of claim 10, wherein the step of entering and/or selecting desired reminder information using the TagToe user interface further includes specifying one or more recipient phone numbers.

13. The method of claim 10, wherein the software application is an online calendar or a scheduling program.

14. The method of claim 10, wherein the step of formulating the scheduled TagToe information also includes incorporating location-specific information which is in addition to the desired reminder information originally entered into the TagToe user interface and/or selected by the user.

15. A TagToe-enabled online calendar system configured to remind a user scheduled TagToe information at a specific time slot by a voice telephone call, the TagToe-enabled online calendar system comprising:

an online calendar interface for scheduling meetings, appointments, and reminders, wherein the online calendar interface is TagToe-enabled and is configured to open a TagToe user interface;

a group of information entered into the TagToe user interface and/or selected by a user, wherein the group of information includes the specific time slot and a product or a service, which is tagged ("TagToe-ed") by the user for a user-self scheduled purchase reminder;

a computer system configured to store some or all portion of the group of information entered into the TagToe user interface and/or selected by the user;

a text-to-speech conversion program configured to produce a voice-version of the user-self-scheduled purchase reminder from some or all portion of the group of information entered into the TagToe user interface and/or selected by the user, wherein the voice-version of the user-self-scheduled purchase reminder becomes some or all portion of the scheduled TagToe information and wherein the scheduled TagToe information also integrates e-commerce specific and product-specific information from an e-commerce infrastructure and an electronic transaction system to enable an interactive voice response (IVR)-based telephonic purchase of the product or the service previously tagged by the user; and a TagToe alert scheduler configured to initiate a telephone call to the user at the specific time slot, wherein the telephone call triggered by the TagToe alert scheduler delivers the scheduled TagToe information, and wherein the scheduled TagToe information includes the voice-version of the user-self-scheduled purchase reminder of the product or the service previously tagged by the user.

16. The TagToe-enabled online calendar system of claim 15, wherein the group of information entered into the TagToe user interface and/or selected by the user further includes contact information for at least one telephone call recipient.

17. The TagToe-enabled online calendar system of claim 15, wherein the group of information entered into the TagToe user interface and/or selected by the user further includes user-defined textual and/or multimedia information.

18. The TagToe-enabled online calendar system of claim 15, wherein the TagToe alert system is configured to accommodate a conference call among the user and other telephone call recipients after delivering the scheduled TagToe information to the user.

19. The TagToe-enabled online calendar system of claim 15, wherein the scheduled TagToe information further comprises a text message, interactive voice response (IVR) information, and/or multimedia information.

20. The TagToe-enabled online calendar system of claim 15, wherein the TagToe alert scheduler is directly or indirectly connected to a public-switched telephone network (PSTN) and/or a mobile-phone service network.

* * * * *